US005403005A

United States Patent [19]

Avila-Valdez

[11] Patent Number: 5,403,005

[45] Date of Patent: Apr. 4, 1995

[54] GAME AND PUZZLE BOARD

[76] Inventor: Jesus Avila-Valdez, Quinta Tranquila No. 21 Col. Las Quintas, Hermosillo, Sonora, Mexico

[21] Appl. No.: 103,205

[22] Filed: Aug. 9, 1993

[51] Int. Cl.[6] ..... A63F 9/10

[52] U.S. Cl. ..... 273/157 R; 273/160

[58] Field of Search ..... 273/153 R, 156, 157 R, 273/160; 446/111, 122

[56] References Cited

U.S. PATENT DOCUMENTS

| | | | |
|---|---|---|---|
| 207,124 | 8/1878 | Kinsey | 273/157 R |
| 231,963 | 9/1880 | Luers | 273/157 R |
| 1,132,244 | 3/1915 | Decenhardt | 273/157 R |
| 1,230,263 | 6/1917 | Alexander | 273/157 R |
| 1,636,371 | 7/1927 | Kenney | 273/157 R |
| 2,225,612 | 12/1940 | Allen | 446/122 |
| 3,302,311 | 2/1967 | Israel | 273/157 R |
| 4,458,441 | 7/1984 | Bril | 446/122 |
| 4,568,082 | 2/1986 | Musolino | 273/157 R |
| 4,629,431 | 12/1986 | Sanders | 273/157 R |

FOREIGN PATENT DOCUMENTS

| | | | |
|---|---|---|---|
| 261772 | 7/1913 | Germany | 273/157 R |
| 23327 | of 1897 | United Kingdom | 273/157 R |

*Primary Examiner*—Vincent Millin
*Assistant Examiner*—Steven B. Wong

[57] ABSTRACT

A puzzle kit includes a rectangular frame of interconnected side members which forms a border for a working area designed to receive a plurality of different puzzle pieces. The side members of the frame include a plurality of holes extending therethrough. The puzzle pieces are provided with a plurality of transverse passageways extending through the puzzle pieces so that when the puzzle pieces are properly arranged within the working area, the holes and passageways are generally aligned. Elongated pin elements are inserted into the aligned passageways and holes to maintain the puzzle pieces at a fixed position within the frame member. When not in use, the frame member, with assembled puzzle pieces and locking pins, may be stored by inserting the frame into a channel formed in a base member. The non-assembled puzzle pieces may be stored by inserting the pin elements through passageways in the puzzle pieces and then inserting the pin elements in cavities formed in the base member. In preferred form, the puzzle pieces are arranged to form a checkerboard or chessboard pattern.

8 Claims, 4 Drawing Sheets

GAME AND PUZZLE BOARD

BACKGROUND OF THE INVENTION

1. Field of the Invention

The present invention relates generally to puzzle toys and more particularly to puzzles having a plurality of elements which are arranged together to form a predetermined pattern.

2. Description of the Prior Art

Puzzles with moveable pieces have been discussed in a variety of U.S. Patents. For example, U.S. Pat. No. 4,583,742 discloses a block and board puzzle game in which a plurality of different shaped blocks are positioned on a game board. U.S. Pat. No. 4,699,385 discloses a chess board puzzle in which a plurality of different sectional puzzle pieces are positioned on a puzzle board to form a chessboard pattern. The puzzle board and sectional pieces are provided with hook and loop pile fasteners to maintain the sectional pieces in position on the puzzle board. As such, chess pieces with like hook and loop pile fasteners may be used on the board. Further, U.S. Pat. No. 4,988,103 discloses a geometric puzzle of spheres which are positioned on a board having different geometric recesses to receive the spheres so that the spheres can be positioned in both planar and three dimensional patterns. Other puzzle structures are further disclosed in U.S. Pat. Nos. 4,358,115, 4,365,809, 4,385,467, and 4,844,466. Means for storing puzzles and board games are disclosed in U.S. Pat. Nos. 3,880,429 and 4,486,018. In U.S. Pat. No. 3,880,429, a storage container or carrying case is provided for storing a game board, such as a chessboard, and playing pieces for use on the game board. U.S. Pat. No. 4,486,018 discloses a transparent container for a plurality of puzzle pieces.

Disadvantages with various puzzles and game boards include inefficient provision for storing the devices and that various playing and puzzle pieces often become separated from the storage devices. Where a puzzle consists of a plurality of separable or moveable puzzle pieces it is especially difficult to ascertain if some of the puzzle pieces are missing when the puzzle has been stored or is spread apart for a period of time. Further, although storage containers have been developed for storing various puzzle and game pieces, these containers are not usually found to be sufficiently aesthetically compatible with living and dining areas or office environments so they are often stored in desks or closets. When stored in this manner, the puzzles are often forgotten or they become buried under other non-similar items with which they are stored. This may be more pertinent with puzzle devices which normally receive less attention as the user becomes more familiar with the operation and solution of the puzzle. These are often placed in storage and forgotten by the user if they do not have other utility.

The foregoing advantages are accomplished by the unique puzzle and game board kit of the present invention as will be made apparent from the following description thereof. Other advantages of the present invention over the prior art also will be rendered evident.

SUMMARY OF THE INVENTION

To achieve the foregoing and other advantages, the present invention, briefly described, provides a game and puzzle board in the form of a kit which includes a rectangular frame of interconnected side members which form a border for a working area designed to receive a plurality of different puzzle pieces. The side members of the frame include a plurality of holes extending therethrough. The puzzle pieces are provided with a plurality of transverse passageways extending through the puzzle pieces so that when the puzzle pieces are properly arranged within the working area, the holes and passageways are generally aligned. Elongated pin elements are inserted into the aligned passageways and holes to maintain the puzzle pieces at a fixed position within the frame member. When not in use, the frame may be stored by inserting the frame into a channel formed in a base member and the pin elements are normally inserted through passageways in the puzzle pieces and then the pin elements are inserted into cavities formed in the base member.

The above brief description sets forth rather broadly the more important features of the present invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent construction insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved game and puzzle board which has all of the advantages of the prior art and none of the disadvantages.

It is another object of the present invention to provide a new an improved game and puzzle board which may be easily and efficiently manufactured and marketed.

It is a further objective of the present invention to provide a new and improved game and puzzle board which is of durable and reliable construction.

Still yet a further object of the present invention is to provide a new and improved game and puzzle board which is designed to provide a challenging educational puzzle which has utility as a game board and which can be stored when not in use in an aesthetic manner.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved game and puzzle board embodying the principles and concepts of the present invention will be described.

Figure 1:
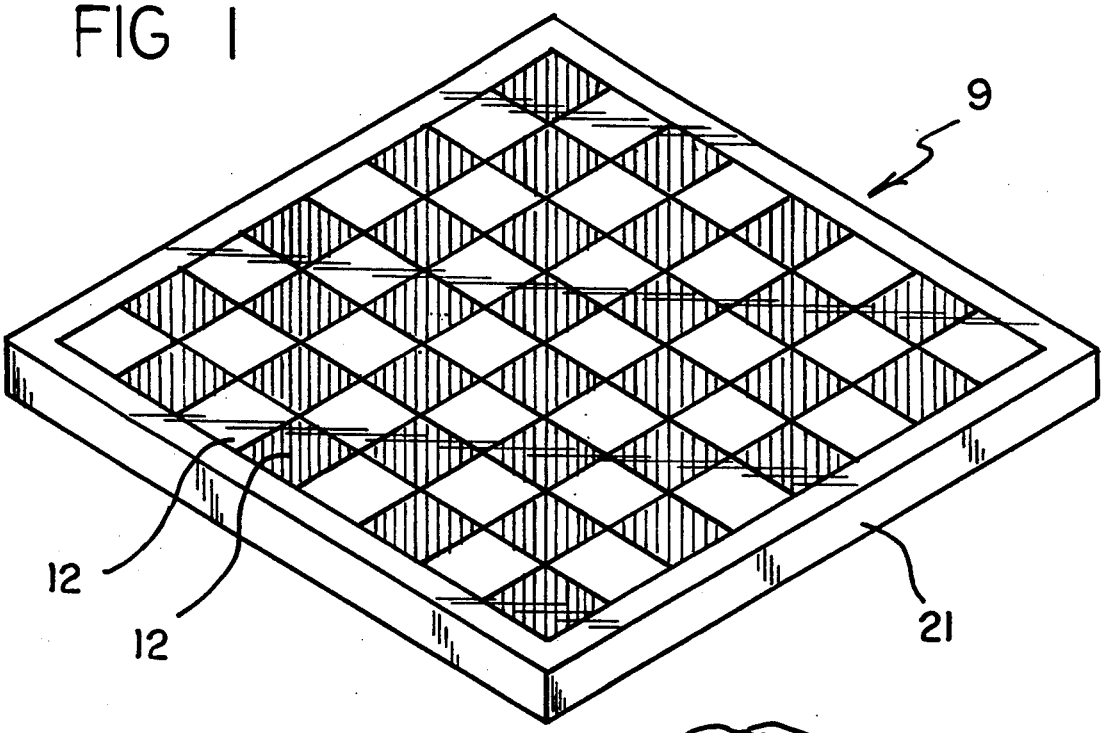
FIG. 1 is a general perspective view depicting the general arrangement of the puzzle pieces arranged within the frame member.
Figure 2:
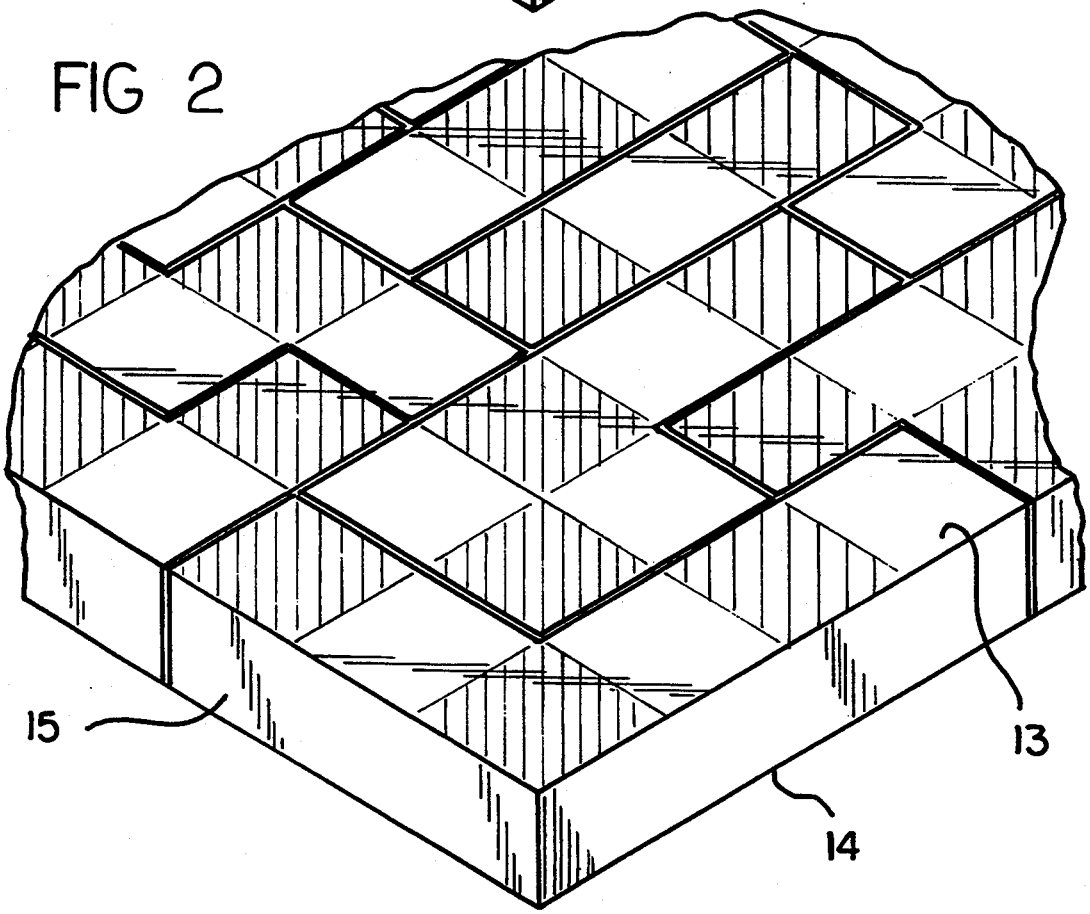
FIG. 2 is general sectional view of the interlocking arrangement of the puzzle pieces in an assembled condition.
Figure 3:
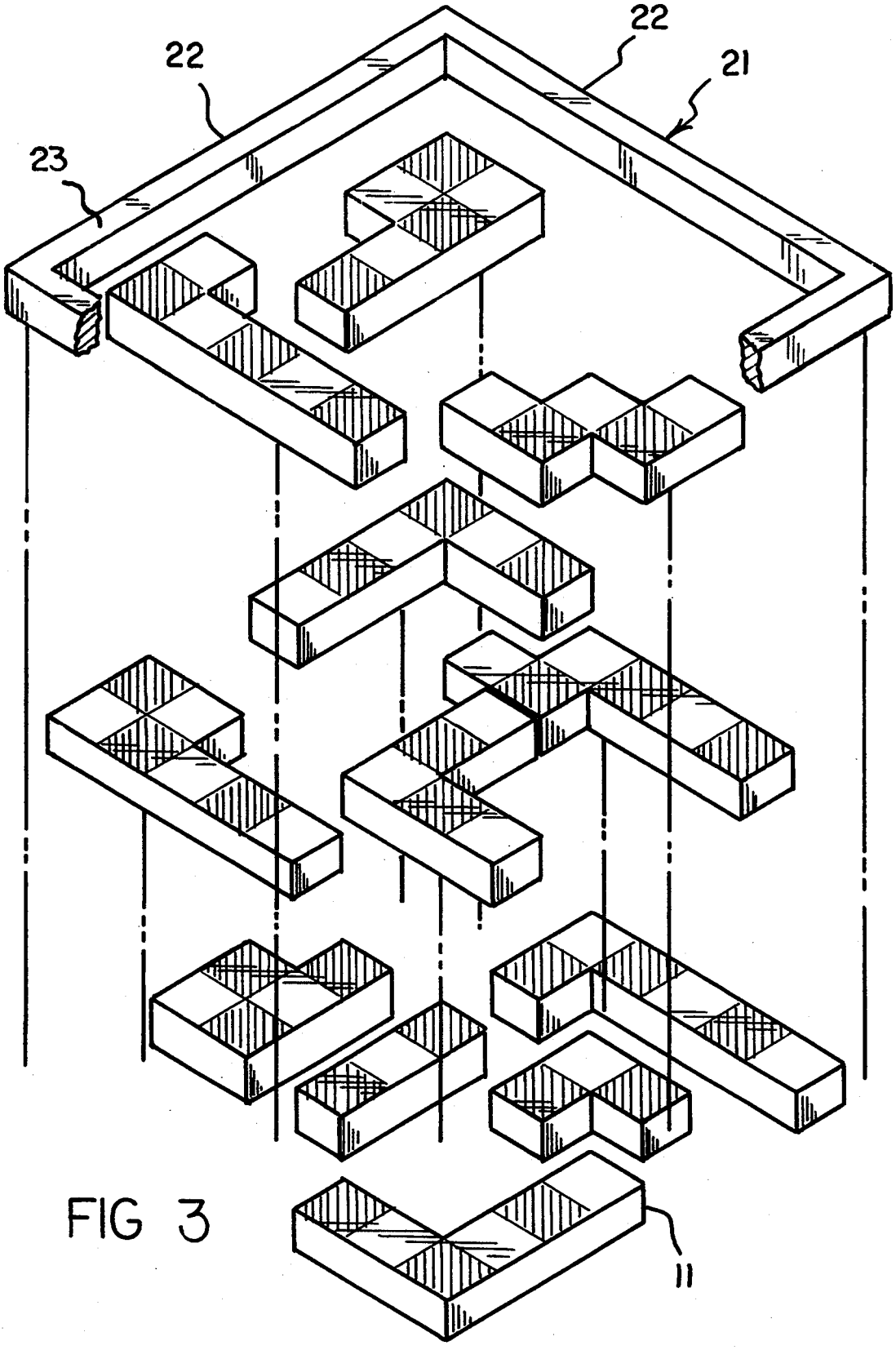
FIG. 3 is a broken apart view showing the manner in which a particular configuration of puzzle pieces may be assembled into the frame member.

Referring now to FIGS. 1–3, there is generally shown one preferred arrangement of the game and puzzle board 9 of the present invention wherein a plurality of puzzle pieces are assembled together to form a chessboard or checkerboard pattern. That is, a pattern of squares of different colors or designs in which the adjacent diagonal squares have the same color and the laterally adjacent squares have different colors. The individual puzzle pieces may have a variety of different shapes and sizes and arrangements depending upon the number of puzzle pieces which are chosen to form the puzzle and the particluar difficulty chosen for solving the puzzle when the puzzle is designed. In the particular arrangement shown in FIGS. 2 and 3, the puzzle pieces 11 generally comprise nine L-shaped pieces, two generally Z-shaped pieces and a straight puzzle piece. Each puzzle piece 11 has a plurality of squares of different design 12 so that in the particular disclosed embodiment the adjacent squares are of alternate design.

While the drawings generally depict the upper surface 13 of the puzzle pieces 11 it is contemplated that the lower surfaces 14 of the puzzle pieces 11 may have the same design as the upper sufaces to complicate the solution to the puzzle where the puzzle pieces may be readily inverted. Similarly, the lower surfaces 14 of the puzzle pieces may have a different design to provide a different game board design or an aesthetic picture for public display.

A frame member 21 is useful for forming a border which defines an interior area for receiving the puzzle pieces 11. The frame member 21 generally comprises a plurality of side members 22 which are connected together and each side member generally includes top 23 and bottom 24 surfaces with edge portions 25 extending therebetween.

Figure 4:
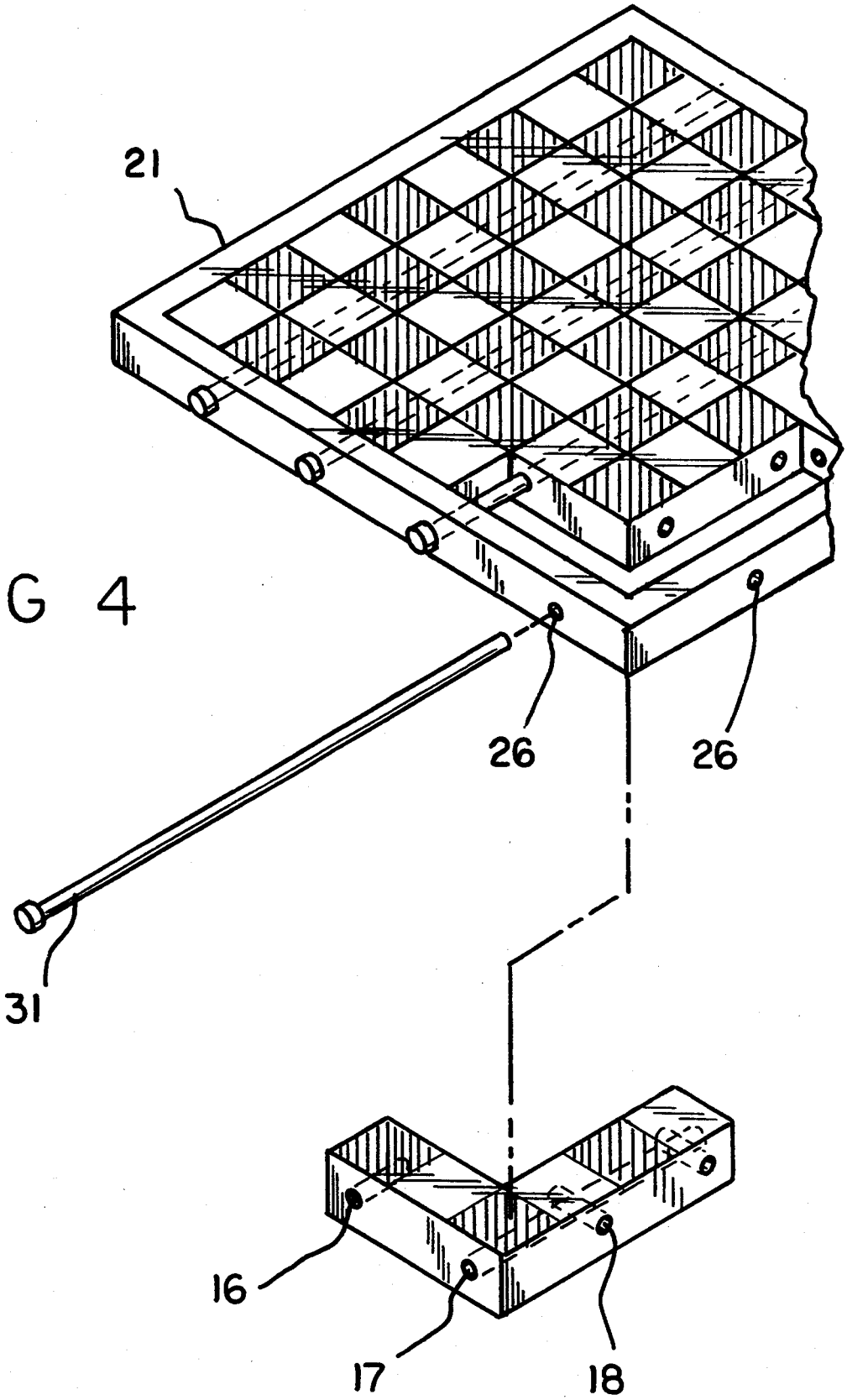
FIG. 4 is broken apart view of the manner in which elongated pin elements are generally used to lock the puzzle pieces within the frame member.

Referring to the structure depicted in FIG. 4, there is generally shown a means for locking the puzzle pieces within a frame in the form of a plurality of elongated locking pins 31 which are inserted through the frame member 21 and each of the puzzle pieces 11. More particularly, the elongated pins 31 are inserted through holes 26 formed in the edge portions 25 of the side members 22 of the frame and elongated pins 31 pass through passageways 16 formed in the sidewalls 15 of the puzzle pieces 11 when the puzzle pieces are properly aligned within the interior area of the frame 21. As shown in the broken away puzzle piece of FIG. 4, the puzzle pieces 11 are generally provided with a transverse arrangement of passageways for receiving a transverse or crossing arrangement of elongated pins. The sidewalls of the puzzle pieces generally include a first set of passageways 17 which are located generally adjacent to the upper surface of the puzzle piece and a second set of passageways 18 which are transverse to the first set and which are generally located adjacent to the lower surface of the puzzle pieces. It is envisioned that a puzzle assembly suitable for use as a game board could be formed by use of just the puzzle pieces and the elongated locking pins. In this instance the locking pins 31 are inserted directly into the aligned passageways in the puzzle pieces when they are properly arranged.

Figure 5:
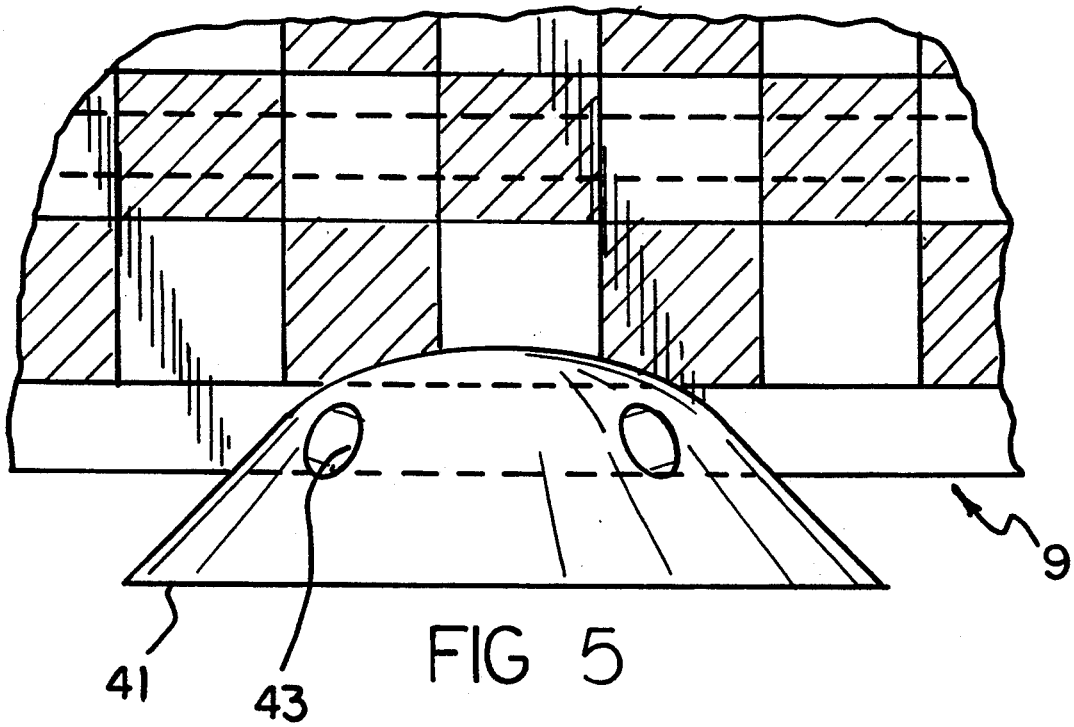
FIG. 5 is side elevation view of the manner in which the frame member and assembled puzzle pieces can be stored in a base member.
Figure 6:
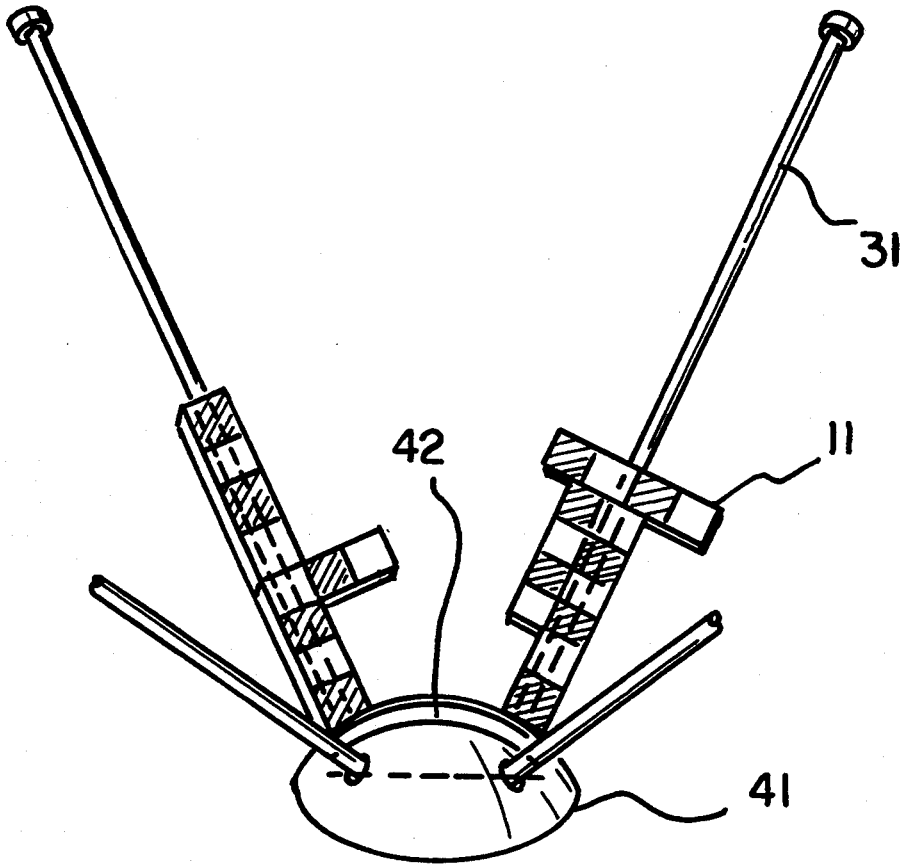
FIG. 6 is a perspective view of the manner in which the elongated locking pins and separate puzzle pieces can be supported in the base member.

For added support and to assist in efficiently storing and using the puzzle pieces, a preferred arrangement is shown in FIG. 4 where the puzzle assembly or kit includes the puzzle pieces 11, frame member 21 and elongated locking pins 31. Use of the frame in combination with the puzzle pieces and locking pins allows the user of the kit to partially assemble the puzzle and lock those puzzle pieces in position which have been properly arranged within the frame member.

Where efficient storage is contemplated, the puzzle assembly or kit may include a base or stand 41 along with the puzzle pieces, frame member and elongated pins. As shown in FIG. 5, the base 41 includes a channel or slot 42 for receiving the frame and a plurality of cavities 43 for receiving the elongated pins. Use of a stand or base 41 allows the user to either efficiently store or aesthetically display the game board and puzzle in either a completely assembled condition where the assembled game and puzzle board is stored in the channel 42 or a partially assembled condition, generally depicted in FIG. 6, where the elongated pins are inserted through the puzzle pieces and the puzzle pieces are then inserted into the cavities 43.

While the present invention has been shown in the drawings and fully described above with particularity and detail in connection with what is presently deemed to be the most practical and preferred embodiments of the invention, it will be apparent to those or ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A kit for a game board and puzzle comprising:

a plurality of planar puzzle pieces, each puzzle piece having a first passageway and a second passageway extending therethrough;

a plurality of elongated stiff pin elements for removeable insertion into the passageways;

frame means for defining an interior area for receiving the puzzle pieces go that when the puzzle pieces are properly assembled within the interior area the puzzle pieces fill in the interior area, the frame means having first and second holes formed therein so that when the puzzle pieces are properly assembled within the interior area the first holes in the frame means are aligned with the first passageways in the puzzle pieces and the second holes in the frame means are aligned with the second passageways in the puzzle pieces, and the pin elements are inserted in the aligned first holes and first passageways and the aligned second holes and second passageways for maintaining the puzzle pieces at a fixed position within the frame means to form a playing board;

a base means for storing the frame means, puzzle pieces and pin elements in disassembled condition when not in use, the base means having a slot formed therein for receiving storing the frame means when not in use, the base means also having a plurality of cavities formed therein for receiving portions of the elongated pin elements when not in use, wherein the puzzle pieces are stored on the base means by passing pin elements through passageways in the puzzle pieces and then inserting the pin elements in the cavities in the base means.

2. The invention according to claim 1, wherein the frame means is formed of a plurality of interconnected elongated side members and the holes are formed in the side members.

3. The invention according to claim 2, wherein the side members of the frame means define a square shaped interior area.

4. The invention according to claim 3, wherein surfaces of the puzzle pieces define a chessboard pattern for use as a game board when the puzzle pieces are properly assembled within the interior area defined by the frame means.

5. The Invention according to claim 1, wherein the base means has a top surface and the slot and cavities are formed in the top surface of the base means for supporting the frame means and the pin elements above the base means.

6. The invention according to claim 1, wherein the first passageways extend generally transverse to the second passageways.

7. The invention according to claim 1, wherein the first passageways and the first holes extend transversely to the second passageways and second holes respectively.

8. A game board and puzzle assembly comprising:

a plurality of puzzle pieces, each puzzle piece having a first passageway and a second passageway extending therethrough;

a plurality of elongated stiff pin elements; and a frame means for defining an interior area for receiving the puzzle pieces so that when the puzzle pieces are properly assembled within the frame means the puzzle pieces substantially fill in the interior area, the frame means formed of a plurality of elongated interconnected side members having first and second holes formed therethrough, and a game board is formed by properly positioning the puzzle pieces within the interior area defined by the frame means with the first passageways of the puzzle pieces aligned with the first holes of the side members of the frame means and with the second passageways of the puzzle pieces aligned with the second holes of the side members of the frame means, and the pin elements are inserted through the respective aligned first holes and first passageways and aligned second holes and second passageways, wherein the side members comprise first, second, third and fourth interconnected side members arranged to form a rectangular frame means with the first and third side members spaced apart and extending generally parallel to each other, wherein the first holes are formed in the first and third side members and the second holes are formed in the second and fourth side members, wherein each puzzle piece has planar upper and lower surfaces and sidewalls and the first and second passageways are formed in the sidewalls of the puzzle pieces, wherein the first and second passageways of each puzzle piece extend transverse to each other, wherein the interconnected side members define a substantially square shaped interior area and the upper and lower surfaces of the puzzle pieces have planar surface portions which adapted to display a chessboard pattern when the puzzle pieces are properly assembled within the frame said pin elements are adapted to extend through said aligned first and second holes in said frame members and through said aligned first and second transverse passageways in said puzzle pieces.

* * * * *